US007175496B1

(12) United States Patent
Lund et al.

(10) Patent No.: US 7,175,496 B1
(45) Date of Patent: Feb. 13, 2007

(54) ANGEL WINGS ASSEMBLY

(75) Inventors: Bruce D. Lund, River Forest, IL (US); Michael D. Starrick, Maywood, IL (US)

(73) Assignee: Lund and Company Invention, L.L.C., Chicago, IL (US)

( * ) Notice: Subject to any disclaimer, the term of this patent is extended or adjusted under 35 U.S.C. 154(b) by 0 days.

(21) Appl. No.: 11/133,667

(22) Filed: May 20, 2005

(51) Int. Cl.
*A63H 33/26* (2006.01)
*A63H 33/00* (2006.01)

(52) U.S. Cl. ..... 446/28; 2/88

(58) Field of Classification Search ..... 446/26–28; 2/69.5, 88, 160; 43/2, 3
See application file for complete search history.

(56) References Cited

U.S. PATENT DOCUMENTS

| | | | | |
|---|---|---|---|---|
| 6,170,188 | B1 * | 1/2001 | Mathews | 43/3 |
| 6,460,284 | B1 * | 10/2002 | Rabo | 43/3 |
| 6,675,522 | B2 * | 1/2004 | Mathews | 43/3 |
| 7,037,163 | B2 * | 5/2006 | Beard | 446/28 |
| 2005/0144828 | A1 * | 7/2005 | Lewis et al. | 43/3 |

* cited by examiner

*Primary Examiner*—Kien Nguyen
(74) *Attorney, Agent, or Firm*—Much Shelist Freed Denenberg Ament & Rubenstein, P.C.

(57) ABSTRACT

An angel wings assembly including a pair of wings supported by a central housing. A lever assembly is provided to operate the wings relative to the central housing. Straps are used to connect the housing to a wearer's back.

4 Claims, 2 Drawing Sheets

ANGEL WINGS ASSEMBLY

BACKGROUND OF THE INVENTION

This invention relates to costume apparel for little children. The wearing of wings is a very popular pastime for little children to play the role of angels in school or church plays. The wing systems currently available that emulate flying by flapping the wings are very cumbersome and not very easy to operate.

There have been a variety of wing devices such as illustrated in Jastreb, et al., U.S. Pat. No. 6,536,049; and Schwartz, U.S. Pat. No. 3,013,797. These are but representative of numerous flying type costumes used by comic book characters such as batman and other angel type and flying human super heroes.

SUMMARY OF THE INVENTION

The angel wing assembly of the present invention is illustrated and described with respect to two embodiments.

In one embodiment, a housing assembly has secured thereto a pair of wings that are moved in a flapping motion by a motor operated gearing system. In a second embodiment the wings are manually flapped by the operation of an air expandable bellows or other means and a spring mechanism for contracting the bellows.

In the case of both the motorized version and the non-motorized or manually operated system, there is provided a pair of levers interconnecting the housing and wings which levers are moved in coordination to give the wings a flapping motion.

The motorized version includes a reversible motor that operates a gear system that includes mating gears on shaft supports which shaft supports are rotated in opposite directions. A lever system includes a pair of levers in which one end thereof is connected to a shaft support and their other ends are connected to pads that are secured to the angel wings. When the levers are moved by the shafts they move the wings in a flapping motion.

The non-motorized version is similarly provided with L-shaped lever assemblies, the intermediate portions of which are connected to shaft supports on which mating gears are located. The mating gears provide positive coordination but the shaft supports could just be rotatably supported by the housing. One end of each lever assembly is connected to a pad secured to a wing. The other ends of the levers are connected to the opposite ends of a bellows. To rotate the lever means in first one direction (the adjacent ends of the levers away from each other) the bellows is expanded by the introduction of air under pressure. The lever ends are moved in the opposite direction (toward each other) when the air is released by a tension spring disposed adjacent the bellows means. More specifically, in the case of the bellows, it receives air through a tube operated by an expandable and contractible bulb. When the bulb is compressed air expands the bellows to move the wings toward each other and when the bulb is released the tension spring compresses the bellows to move the wings away from each other.

Other features and advantages will be apparent from the attached drawings and the description thereof in which:

FIG. 1 is an illustrated embodiment of the motorized version of the angel wings; and FIG. 2 is an illustrated embodiment of the non-motorized version

DESCRIPTION OF THE DRAWINGS

Referring first to the motorized version in FIG. 1 there is shown the wings 10, 12 that are connected to a central housing 14 through levers 16, 18. The housing 14 includes a reversible motor 20 that drives a gear train assembly 22 including mating gears 24, 26 that are mounted on shaft supports 28, 30. Connected to shaft support 28 is one end of lever 16. The other end of lever 16 is connected to a pad 32 that is affixed to the wing 10. The second lever 18 has one end connected to the support shaft 30 and its other end connected to pad 34 affixed to the wing 12. Thus, it can be seen when the mating-gears 24, 26 are operated by the pinion 36 of gear train 22 moving in a clockwise direction the wings are moved toward each other and when the pinion gear 36 is reversed to move in a counter clockwise direction the mating gears are moved in an opposite direction and the wings are moved away from each other to provide the flapping action.

The housing also include a speaker 38, an electronic means 40 and a battery power source 42. The control for the system consists of a switch 44. The strap assembly 46 is used for strapping the angel wing assembly 10 to a wearer. The switch 44 is located on the strap assembly 46.

Also included in the housing is a jiggle switch 48 with self-contained electronics that allows for random activation so the child can experience a more natural play pattern.

Figure 2:
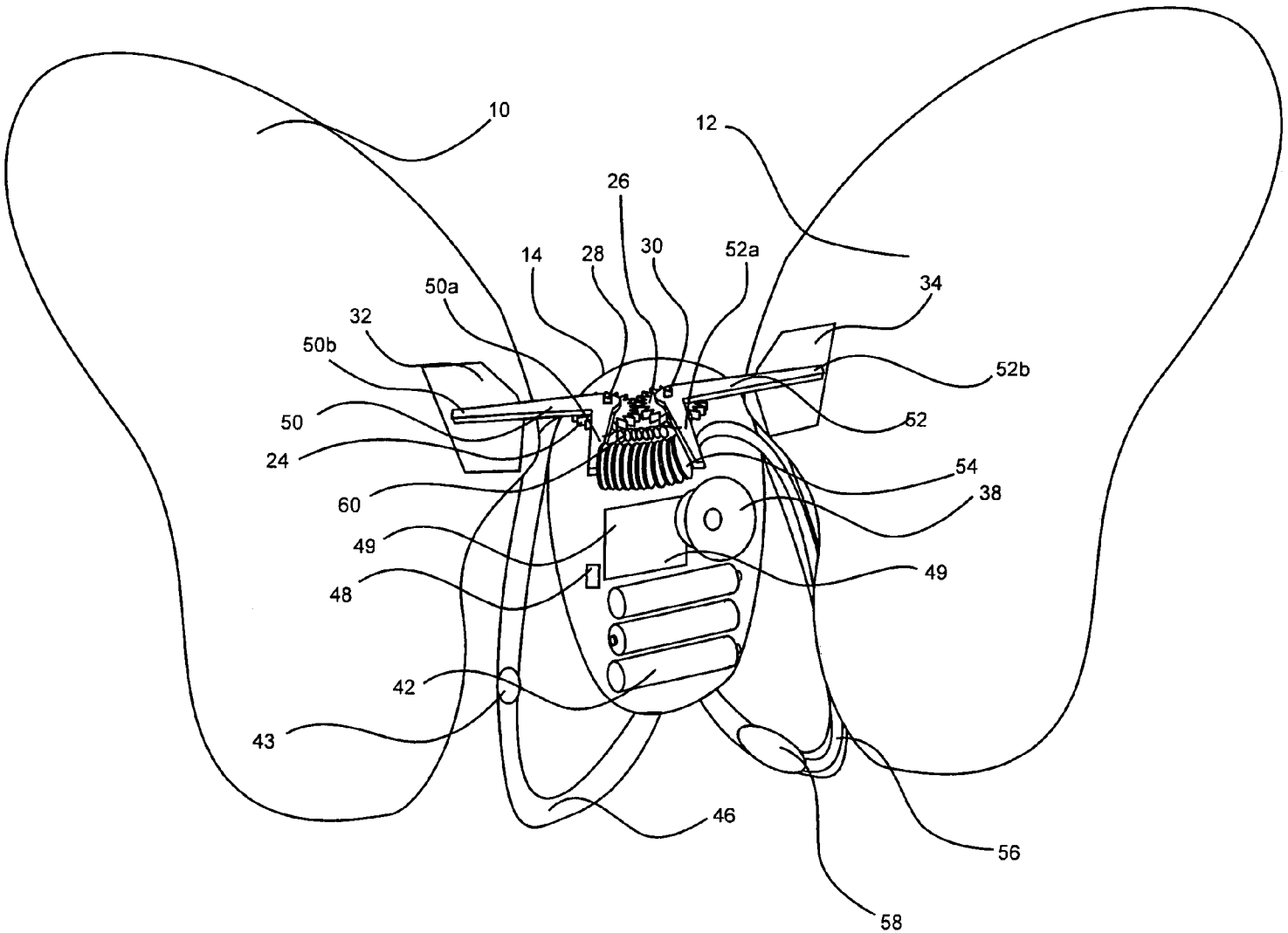

Turning now to FIG. 2, there is illustrated a non-motorized angel wing assembly. The common elements to the motorized assembly includes the wing 10, 12, a central housing 14 and mating gears 24, 26 on shaft supports 28, 30. Also, included are a speaker 38, battery power source 42, a switch 43 to operate the speaker 28 and a jiggle switch 48 with self-contained electronics allowing for random actuation of the electronic means 49 to operate the speaker 38.

Figure 1:
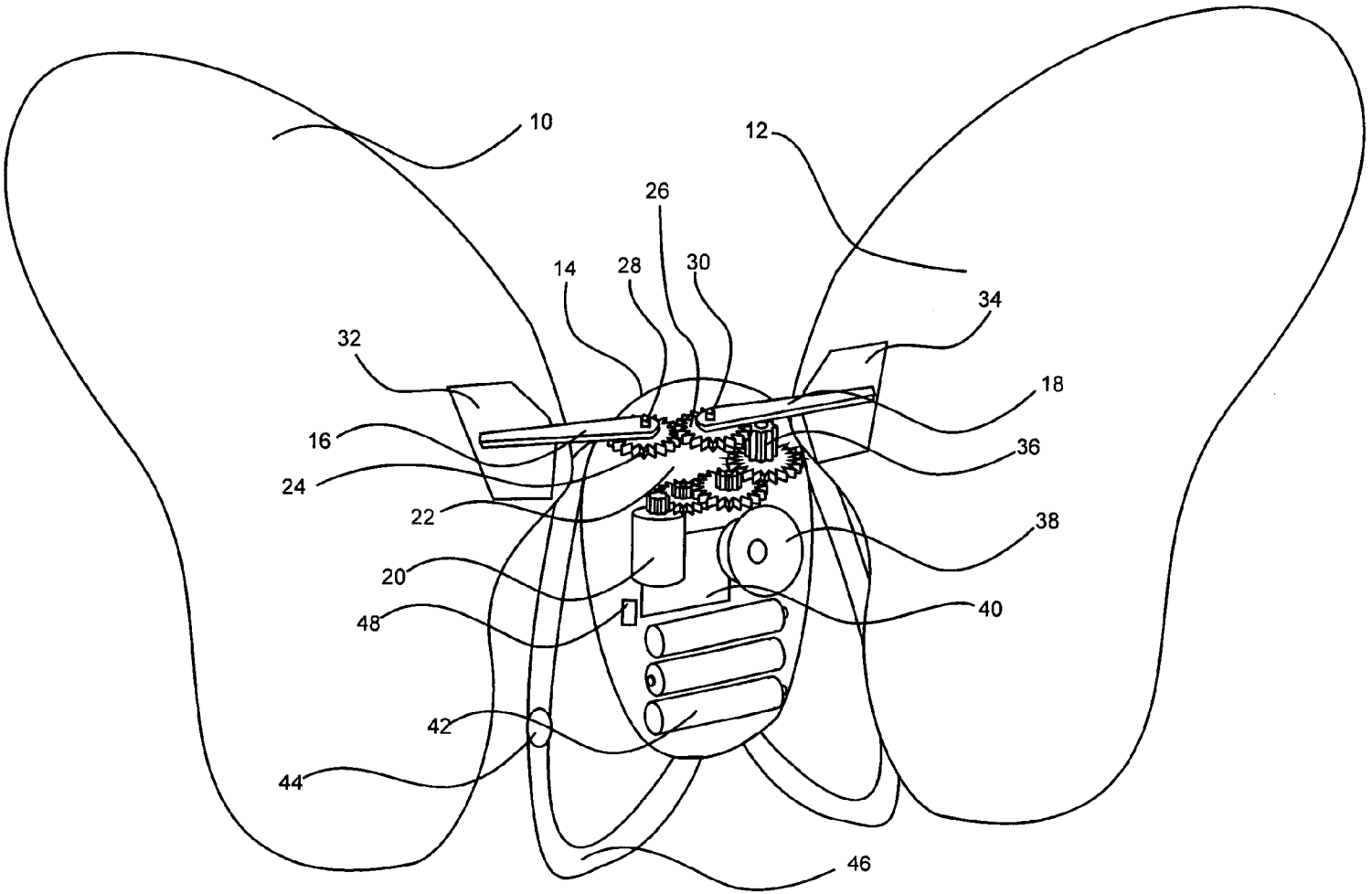

In place of the reversible motor and gear train means disclosed in FIG. 1, there is a manual system employed to operate the L-shaped levers 50, 52 the central portions of which are connected to shaft supports 28, 30. Thus, when the levers are moved about shaft supports 28, 30 they act to flap the wings 10, 12.

Specifically, each of the levers have their ends 50*a* and 52*a* secured to opposite ends of the bellows 54. The other ends of the levers 50*b* and 52*b* are connected to the pads 32, 34 secured to their respective wings 10, 12.

The bellows 54 is connected to a tube 56 through which air under pressure is supplied by bulb 58. The compression of bulb 58 forces air into bellows 54 to expand the bellows to move the 50*a*, 52*a* away from each other about the support shafts 28, 30. Located adjacent the bellows 54 is a tension spring 60 connected to the lever arms 50*a*, 52*a* to compress the bellows 54 when the bulb 58 is released moving the lever arms 50*a*, 52*a* toward each other and the wings connected to arms 50*b*, 52*b* away from each other. Thus, the compression and release of the bulb 58 brings about the wing flapping action.

It is intended to cover by the appended claims all features and embodiments that fall within the true spirit and scope of the invention.

The invention claimed is:

1. An angel wings assembly comprising a central housing, a pair of wings, housing support means for said wings including two upwardly extending shafts, moveable lever means comprising two generally L-shaped levers each connected at their mid-point to one of said shafts in which the end of one leg of each L-shaped member is connected to an angel wing and the end of the other leg is connected to means for rotating each shaft and its respective L-shaped lever to flap the angel wings, means for moving said lever means relative to said support means to flap said wings, and means for connecting the housing to a wearer's back.

2. An angel wing assembly as set forth in claim 1 in which the means for moving said levers include a bellows and spring means located between the legs of said levers not connected to said wings and operable to move the levers in opposition directions.

3. An angel wing assembly as set forth in claim 2 in which the bellow receives compressed air from a tube to expand the bellow to move the levers in opposed directions and the spring means is a tension spring to move the levers toward each other when the air is released from said bellows.

4. An angel wing assembly as set forth in claim 3 in which there are provided means for controlling the flow of air including an expandable and contractible bulb connected to said tube.

* * * * *